US005820429A

United States Patent [19]

Smedal et al.

[11] Patent Number: 5,820,429

[45] Date of Patent: Oct. 13, 1998

[54] ARRANGEMENT IN A LOADING/ UNLOADING BUOY FOR USE IN SHALLOW WATERS

[75] Inventors: Arne Smedal, Eaervik; Kare Syvertsen; Arild Bech, both of Arendal, all of Norway

[73] Assignee: Den Norske Stats Oljeselskap A.S., Stavanger, Norway

[21] Appl. No.: 836,551

[22] PCT Filed: Nov. 3, 1995

[86] PCT No.: PCT/NO95/00202

§ 371 Date: Jul. 14, 1997

§ 102(e) Date: Jul. 14, 1997

[87] PCT Pub. No.: WO96/14237

PCT Pub. Date: May 17, 1996

[30] Foreign Application Priority Data

Nov. 4, 1994 [NO] Norway ..... 944211

[51] Int. Cl.[6] ..... B63B 22/02

[52] U.S. Cl. ..... 441/5; 114/230

[58] Field of Search ..... 441/2–5; 114/230, 114/293

[56] References Cited

U.S. PATENT DOCUMENTS

| | | | |
|---|---|---|---|
| 3,236,266 | 2/1966 | Bily | 114/230 |
| 3,236,267 | 2/1966 | Bily | 114/230 |
| 3,694,837 | 10/1972 | Von Norring | 441/3 |
| 3,999,498 | 12/1976 | Flory | 114/230 |
| 5,431,589 | 7/1995 | Corona | 441/4 |

FOREIGN PATENT DOCUMENTS

| | | | |
|---|---|---|---|
| 2 257 406 | 1/1993 | United Kingdom . | |
| 87/05876 | 10/1987 | WIPO | 441/3 |
| 93/11032 | 6/1993 | WIPO | 114/293 |

*Primary Examiner*—Sherman Basinger

*Attorney, Agent, or Firm*—Sughrue, Mion, Zinn, Macpeak & Seas, PLLC

[57] ABSTRACT

An arrangement in a loading/unloading buoy for use in shallow waters, wherein the buoy (1) is arranged for introduction and releasable securement in a downwardly open receiving space in a floating vessel, the buoy comprising a bottom-anchored center member (2) for the passage of medium from or to a transfer line (25) which is coupled to the underside of the center member (2), and an outer member (4) which is rotatably mounted on the center member to allow turning of the vessel about the center member when the outer member is secured in the receiving space. The buoy is provided with a bottom support structure (15) which is connected to the center member (2) of the buoy and arranged for support of the buoy at the sea bed (16) when it is not in use, and to the center member of the buoy there are connected a number of mooring lines (21) extending outwards from the buoy (1) a substantial distance along the sea bed (16) and having an inherent elasticity allowing raising of the buoy from the sea bed.

10 Claims, 3 Drawing Sheets

ARRANGEMENT IN A LOADING/UNLOADING BUOY FOR USE IN SHALLOW WATERS

BACKGROUND OF THE INVENTION

The invention relates to an arrangement in a loading/-unloading buoy for use in shallow waters, wherein the buoy is arranged for introduction and releasable securement in a downwardly open receiving space in a floating vessel, the buoy comprising a centre member arranged for anchoring to the sea bed and having a passage for transfer of flowable medium from or to a transfer line coupled to the underside of the centre member, and an outer member rotatably mounted on the centre member to allow turning of the vessel about the centre member when the outer member is secured in the receiving space.

A loading/unloading buoy of the above-mentioned type e.g. is known from Norwegian laying-open print No. 175 421. This known buoy especially is intended for offshore loading or unloading of hydrocarbons (oil and gas). The outer member of the buoy constitutes a buoyancy member, and when the buoy is not in use, the buoy floats submerged at a chosen distance beneath the sea level, the buoyancy of the buoy corresponding to the weight of the anchoring system of the buoy. In use, the buoy is hoisted up by means of a pick-line attached to the buoy, and the outer member of the buoy is secured in a submerged receiving space at the bottom of the topical vessel, for instance a so-called shuttle tanker. The buoy structure allows the vessel, during loading/unloading operations, to turn about the bottom-anchored centre member of the buoy, under the influence of wind, waves and water currents. Thus, the buoy constitutes a submerged rotating body or turret, and the technique of buoy loading with the use of a buoy of this special type today therefore goes under the designation STL technique (STL= Submerged Turret Loading). This technique has turned out to have very substantial advantages in practice, as both connection and disconnection between vessel and buoy can be carried out in a simple and quick manner, even in bad weather with relatively high waves. Further, the buoy can remain connected to the vessel in all weathers, a quick disconnection being able to be carried out if a weather limitation should be exceeded.

In practice it is often of interest to carry out loading and unloading of hydrocarbons in shallow waters, for example close to an oil refinery. Also in such situations it would be desirable to be able to use the STL technique, partly because of the practical advantages mentioned above, for example in regions having relatively large tide differences and/or strong water currents, and partly for economical reasons, for example in order to be able to save larger investments in connection with the building of quay facilities or the like. The need for such a utilization also exists because of the fact that today ships are built wherein this is the only loading/unloading system which is used when the ship is not alongside a quay.

SUMMARY OF THE INVENTION

Thus, the object of the invention is to further develop a buoy of the mentioned type, so that it is suitable for use in shallow waters.

According to the invention the above-mentioned object is achieved in that the buoy is provided with a bottom support structure which is connected to the centre member of the buoy and arranged for support of the buoy on the sea bed when it is not in use, a number of mooring lines being connected to the first member of the buoy and extending outwards from the buoy a substantial distance along the sea bed and having an inherent elasticity allowing raising of the buoy from the sea bed.

With the expression "shallow waters" in this context is meant places at which the depth normally may be in the range of 25–60 meters. The mooring line then advantageously may have a length in the range of 0.5–2 km, the inherent elasticity of the anchor line system then being utilized. The mooring lines then may consist of wires or common anchor chain, the chain links over the long line length then giving the necessary elasticity which is required to allow raising of the buoy from the bottom up to the topical vessel. Alternatively, there may be used mooring lines of a synthetic material having a certain inherent elasticity, whereby line lengths may be used which may be shorter than approximately 0.5 km.

BRIEF DESCRIPTION OF THE DRAWINGS

The invention will be further described below in connection with an exemplary embodiment with reference to the drawings, wherein.

DETAILED DESCRIPTION OF THE PREFERRED EMBODIMENT

Figure 1:
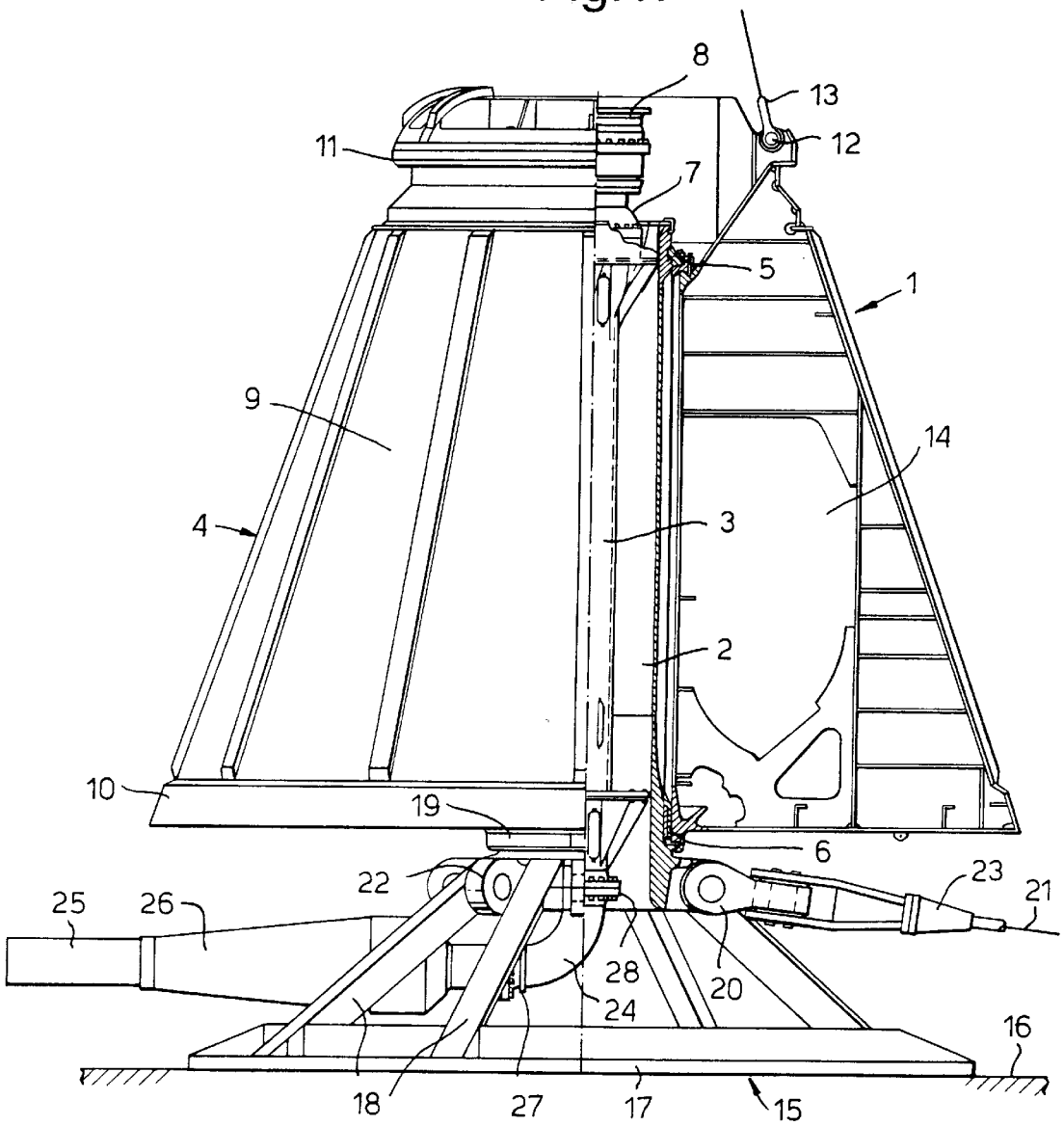
FIG. 1 shows a partly sectioned side view of a buoy which is provided with an arrangement according to the invention.
Figure 2:
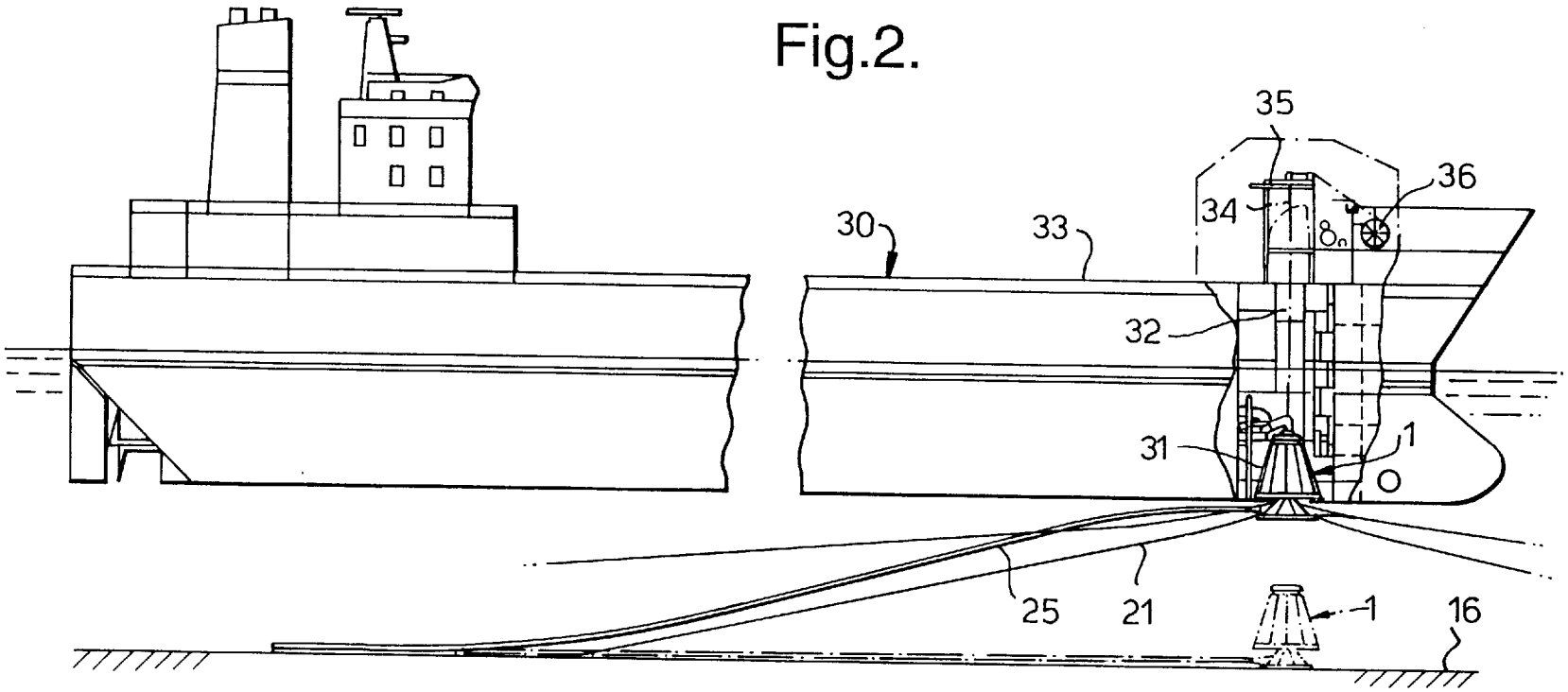
FIG. 2 shows a side view of the buoy arrangement according to the invention, wherein the buoy is shown both in a bottom position and in a position introduced into the receiving space in a vessel.

The buoy structure 1 shown in FIG. 1 comprises a central member or centre member 2 in the form of a hollow shaft having a passage 3 for medium (e.g. petroleum products) which is to be transferred via the buoy, and an outer member 4 which, by means of suitable bearing means 5, 6, is rotatably mounted on the centre member 2 and arranged to be secured in a releasable manner in an adapted receiving space in the topical vessel (see FIG. 2). The centre member 2 at its upper end is provided with a swivel unit 7 and a valve unit 8 for connection to a pipe system (not shown) arranged on the topical vessel in communication with the tanks of the vessel. The outer member 4 comprises a main cone section 9, a lower adaptation ring 10 for the transfer of occurring load forces to the receiving space, and an upper locking collar 11 which is adapted for engagement with locking elements in the receiving space. At the upper end of the buoy there are arranged lugs 12 for connection of a so-called lifting bridle (partly suggested at 13) which is connected to the pick-up line (not shown) of the buoy for raising of the buoy when this is to be introduced into the receiving space. Further, the outer buoy member 4 is provided with a plurality of chambers 14 which may advantageously be designed so that the buoyancy of the buoy may be adjusted.

The above-mentioned structure in all essentials corresponds to the structure according to the above-mentioned laying-open print. A further description thereof is unnecessary for the understanding of the invention, and reference is made to said publication for a further description of details.

In accordance with the invention the buoy 1 is provided with a bottom support structure 15 which is connected to the centre member 2 of the buoy and arranged for support of the buoy at the sea bed 16 when it is not in use. In the illustrated embodiment, the support structure comprises a ring-shaped or annular support body 17 and a number of rod-shaped braces 18 of which the lower ends are attached, e.g. by welding, to the support body, and of which the upper ends are attached to a reinforced holding portion 19 of the centre member 2 of the buoy at the lower end thereof, so that the braces are mutually converging in the direction towards the centre member. With a suitable dimensioning of the ring body 17 and the braces 18 there is obtained a stable and robust support of the buoy.

A number of coupling links 20 for connection of respective mooring lines 21 for the buoy are attached to the holding portion 19, and more specifically to respective lugs 22 extending outwards in the intermediate spaces between the braces 18 at the upper ends thereof. The coupling links may consist of U-shaped elements which are rotatably attached to the lugs 22 by means of hinge bolts, and the mooring lines 21 may, as shown, be attached to the coupling links 20 via terminating elements 23 which are attached to the coupling links through a rotary connection having an axis which is normal to the axis of rotation of said hinge bolts. Thus, the mooring lines 21 are attached to the centre member 2 of the buoy through respective universal joints, to be able to move both in the vertical and the horizontal plane without the holding portion 19 of the centre member being subjected to bending moments.

As an example, there may be arranged eight mooring lines 21, a corresponding number of lugs 22 being arranged around the holding portion, in the intermediate spaces between a corresponding number of braces 18.

As shown in FIG. 1, the lower end of the centre member 2 of the buoy is connected to a transition pipe member 24 for connection to—in the illustrated embodiment—an essentially horizontally extending end portion of the topical transfer line 25. The transfer line may, e.g., be a flexible riser which, in the illustrated embodiment, is coupled to the pipe member 24 through a stiffener member 26. The pipe member 24 is shown in the form of a ninety degrees bend which is provided with end flanges 27, 28 for connection to corresponding end flanges at the lower end of the centre member 2 at the end of the transfer line 25.

In the side view in FIG. 2 the buoy 1 is shown both in an inoperative position wherein it is placed at the sea bed 16, and in an operating position wherein it is introduced into a receiving space at the bottom of a vessel 30, for example for the transfer of oil from loading tanks (not further shown) on the vessel through the riser 25 to an onshore tank installation.

As appears from the Figure, a submerged downwardly open receiving space 31 is arranged at the bottom of the vessel at the bow portion thereof. Above the receiving space there is arranged a shaft 32 extending from the receiving space up to the deck 33 of the vessel, so that the buoy can be hoisted up and introduced into the receiving space by means of a line 34 which is passed through a suitable guide frame 35 to a winch means 36. At the receiving space there is arranged a suitable locking means for releasable securement of the buoy in the receiving space, and also a suitable coupling unit for putting the central passage of the buoy in fluid communication with a pipe system leading to the storage tanks of the vessel for the medium in question.

A vessel of the topical type for example is known from Norwegian laying-open print No. 175 420, and reference is here made to this publication for a further description of the structural details of the above-mentioned equipment.

Figure 3:
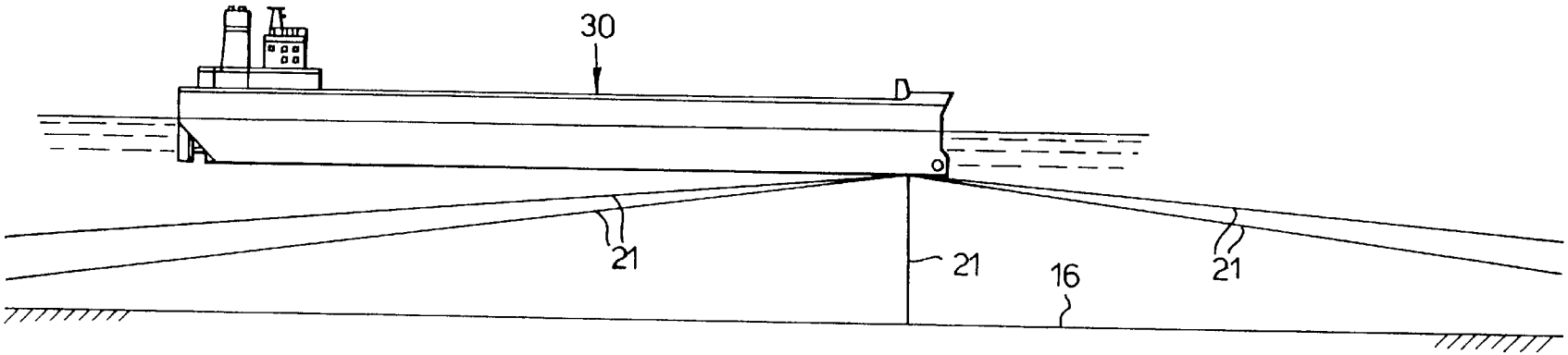
FIG. 3 shows a survey view of the vessel in FIG. 2 and the long mooring lines in the buoy arrangement.

FIG. 3 shows a survey view of the vessel 30 wherein the buoy is introduced into the receiving space in the bow portion of the vessel and the mooring lines 21 of the buoy extend in tight condition outwards from the buoy over a relatively long distance in the sea, before the lines in their outer region (outside of the Figure) rest against the sea bed over a relatively long distance forward to the respective anchoring points.

We claim:

1. A submerged turret loading (STL) arrangement including a loading/unloading buoy for use in shallow waters, wherein the buoy (1) configured for introduction and releasable securement in a downwardly open receiving space (31) in a floating vessel (30), the buoy comprising a centre member (2) adapted to be anchored to the sea bed (16) and having a passage (3) for transfer of a flowable medium from or to a transfer line (25) coupled to an underside of the centre member, and an outer member (4) rotatably mounted on the centre member to allow turning of the vessel about the centre member when the outer member is secured in the receiving space wherein the buoy further comprises a bottom support structure (15) connected to the centre member of the buoy and configured to support the buoy on the sea bed (16) when not in use, a plurality of mooring lines (21) being connected to the centre member of the buoy and extending outwards therefrom a substantial distance along the sea bed and having an inherent elasticity allowing raising of the buoy from the sea bed, and wherein the buoy and mooring lines serve as an anchoring system for the vessel when the buoy is secured thereto.

2. An arrangement according to claim 1, wherein the bottom support structure comprises a ring-shaped support body (17) and a number of rod-shaped braces (18) having lower ends attached to the support body, and upper ends attached to the centre member of the buoy, the braces mutually converging in a direction towards the centre member.

3. An arrangement according to claim 1, wherein that the mooring lines are attached to the centre member of the buoy through universal joints (22, 23).

4. An arrangement according to claims 1, wherein that the mooring lines have a length in the range of 0.5–2 km.

5. An arrangement according to claim 4, wherein that the mooring lines comprising anchor chain.

6. An arrangement according to claim 4, wherein the mooring lines comprising of a synthetic material.

7. An arrangement according to claim 1 wherein a lower end of the centre member of the buoy is connected to a transition pipe member (24) for connection to a generally horizontally extending end portion of the topical transfer line.

8. An arrangement according to claim 7, wherein that the transition pipe member has is a 90° bend and end flanges (27, 28) for connection to corresponding end flanges at the lower end of the centre member and at the end portion of the transfer line.

9. An arrangement according to claim 1 wherein that the outer member (4) of the buoy is provided with a buoyancy means (14) having an adjustable buoyancy.

10. An arrangement according to claim 9, wherein the buoyancy means comprises a number of buoyancy chambers 14) in the interior of the outer member.

* * * * *